US010907357B2

(12) United States Patent
MeGee

(10) Patent No.: US 10,907,357 B2
(45) Date of Patent: Feb. 2, 2021

(54) EXPANDABLE FLASHING DEVICE AND SYSTEM

(71) Applicant: ROOFCO LLC, Caldwell, ID (US)

(72) Inventor: Aaron T. MeGee, Eagle, ID (US)

(73) Assignee: ROOFCO LLC, Caldwell, ID (US)

( * ) Notice: Subject to any disclaimer, the term of this patent is extended or adjusted under 35 U.S.C. 154(b) by 0 days.

(21) Appl. No.: 16/793,284

(22) Filed: Feb. 18, 2020

(65) Prior Publication Data

US 2020/0181917 A1 Jun. 11, 2020

Related U.S. Application Data

(62) Division of application No. 16/141,345, filed on Sep. 25, 2018, now Pat. No. 10,626,617.

(51) Int. Cl.

| | |
|---|---|
| ***E04D 13/15*** | (2006.01) |
| ***E06B 3/58*** | (2006.01) |
| ***E04D 13/14*** | (2006.01) |
| ***E06B 1/62*** | (2006.01) |

(52) U.S. Cl.

CPC ..... *E04D 13/15* (2013.01); *E04D 13/14* (2013.01); *E06B 3/585* (2013.01); *E06B 2001/628* (2013.01)

(58) Field of Classification Search

CPC ..... E04D 13/14; E04D 13/15; E06B 3/585; E06B 2001/628

See application file for complete search history.

(56) References Cited

U.S. PATENT DOCUMENTS

| | | | |
|---|---|---|---|
| 2,822,763 | A | 2/1958 | Berg |
| 4,483,112 | A | 11/1984 | Rueblinger |
| 4,648,218 | A | 3/1987 | Butzen |
| 4,951,431 | A | 8/1990 | Sweers |
| 5,065,553 | A | 11/1991 | Magid |
| 5,522,189 | A | 6/1996 | Mortensen et al. |

(Continued)

FOREIGN PATENT DOCUMENTS

WO 03074812 A1 9/2003

OTHER PUBLICATIONS

Metal-Era, "2 PC Counter Flashing", https://www.metalera.com/Accessories/Counterflashing-Products/2_Pc_Counterflashing.aspx, Mar. 15, 2018, 2 pages.

(Continued)

*Primary Examiner* — Andrew J Triggs

(74) *Attorney, Agent, or Firm* — Berg Hill Greenleaf Ruscitti, LLP

(57) ABSTRACT

An expandable flashing device comprises first and second pieces of flashing material that overlap one another with hems or folded edges located on opposite lateral sides of the pieces that hold the pieces together, yet allow the pieces to slide or shift with respect to one another to selectively change the length of the device. In a first stowed position, the pieces overlap one another and in an expanded second position, the pieces may be pulled apart to increase an overall length of the pieces. The maximum length of material that overlaps between the pieces is defined as the overlap range. The overlap range defines the range to which the device can be shortened or lengthened to fit a particular installation. A flashing system and a method of installing flashing are also disclosed.

15 Claims, 9 Drawing Sheets

(56) References Cited

U.S. PATENT DOCUMENTS

| | | | |
|---|---|---|---|
| 5,553,425 | A | 9/1996 | Sampson et al. |
| 6,167,660 | B1 | 1/2001 | Sama |
| 6,170,211 | B1 | 1/2001 | Boyce |
| 7,059,086 | B2 | 6/2006 | Edvardsen |
| 8,117,789 | B2 | 2/2012 | Teodorovich |
| 8,561,367 | B2 | 10/2013 | Kelly |
| 8,869,466 | B2 | 10/2014 | Garcia et al. |
| 9,356,174 | B2 * | 5/2016 | Duarte ..... E04D 13/1475 |
| 9,745,790 | B2 | 8/2017 | Norwood |
| 2004/0103592 | A1 | 6/2004 | Edvardsen |
| 2005/0279040 | A1 | 12/2005 | Panasik |
| 2009/0031640 | A1 | 2/2009 | Elmes et al. |
| 2013/0055652 | A1 | 3/2013 | Larsson |
| 2013/0192154 | A1 | 8/2013 | Kelly |

OTHER PUBLICATIONS

Metal-Era, "SecurEdge 200 Snap-on", http://www.metalera.com/Private-Label/Carlisle/SecurEdge_200_Snap-on.aspx, Mar. 15, 2018, 2 pages.

* cited by examiner

EXPANDABLE FLASHING DEVICE AND SYSTEM

CROSS REFERENCE TO RELATED APPLICATIONS

This application is a divisional application of U.S. Ser. No. 16/141,345 filed on Sep. 25, 2018, the entire disclosure of which is hereby incorporated by reference herein.

FIELD OF THE INVENTION

The invention relates to construction materials for weatherproofing a structure, and more particularly, to an expandable flashing device for weatherproofing and a related system for weatherproofing a structure including a plurality of expandable flashing devices.

BACKGROUND OF THE INVENTION

Modern construction requires a structure to be weatherproofed in order to comply with various building code requirements. Regardless of building codes, it is necessary to weatherproof a structure as a simple matter of quality construction. One known type of material used to weatherproof the exterior of a structure is flashing. The term "flashing" generally refers to relatively thin pieces of impervious material that are installed to prevent penetration of water into a structure from a joint or connection. Flashing is also commonly used within a larger weather resistant barrier (WRB) system in which flashing is coupled with other types of barrier materials.

Flashing is commonly used in building construction to eliminate or substantially decrease water seepage around objects exposed on the exterior of a building such as windows, roof eves, roof valleys, chimneys, roof vents, exterior walls, and door openings. Flashing may be constructed of thin pieces of metallic material such as aluminum, copper, steel, and metal alloys. More recently, flashing may also be made of composite materials to include molded plastic and others.

With respect to roofing construction, it is particularly important to ensure a roof has a robust weatherproofing design which will effectively deflect and carry water away from seems or joints and valleys where water runoff is concentrated. Without a properly designed weatherproof roof, disastrous damage can occur to the entire structure in which water is capable of damaging both exterior components and the interior of the building. Roofing replacement and repair can be extremely expensive and time-consuming, not to mention costly damage that can be sustained by the interior of a structure and the owner's possessions therein.

There are a number of drawbacks to traditional or common flashing designs. One significant disadvantage is that during construction, a significant number of flashing pieces must be measured and cut in order to match a structure's dimensions at those locations where flashing is required. Sizing and cutting flashing during installation complicates construction efforts.

Another disadvantage of common commercial flashing is that they are manufactured in a relatively long sections or pieces which require the flashing to be transported on a vehicle that has a sufficient length. Accordingly, flashing is most commonly delivered by trailer trucks or trains which may add to the cost of transporting the materials.

Yet another disadvantage of common flashing designs is that the exposed edges or sides of the flashing are not reinforced and accordingly, the edges may become bent or disfigured during transportation and handling.

Considering the drawbacks or disadvantages associated with, common flashing designs, there is a need for a flashing design which provides a user with automatic options for sizing. There is also a need for a flashing design which maintains the simplicity of current designs, but also provides a more robust solution with respect to rigidity and strength of the flashing, particularly at locations around the periphery or edges of the flashing.

SUMMARY OF THE INVENTION

According to one preferred embodiment of the invention, it includes an expandable flashing device comprising first and second pieces of flashing that overly one another and hems or folded edges located on opposite lateral sides of the pieces that hold the pieces together yet allow the pieces to slide or shift with respect to one another. In a first stowed position, the pieces overlap one another and in an expanded second position, the pieces may be pulled apart to increase an overall length of the device. The maximum length of material that overlaps between the pieces is defined as the overlap range. The overlap range defines the range to which the device can be shortened or lengthened to fit a particular installation. A minimum flashing length refers to the minimum length of the pieces when they are fully overlapped, while a maximum flashing length refers to the length of the pieces when there fully pulled apart or expanded.

According to one aspect of this first preferred embodiment, the opposite lateral sides of the pieces that incorporate the hems or folded edges may include fully closed hems, partially open hems, or combinations thereof. In one preferred embodiment, the device at each opposite lateral side has a fully closed hem for the interior piece of material and a partially open hem for the exterior piece of material that overlaps the interior piece. A fully closed hem can be defined as a bend created on a piece of material at approximately a 180° angle. A partially closed hem can be defined as a bend created on a piece of material at an angle of approximately 150-160° thereby leaving an opening at the bend of approximately 20-30° in which the bend of the interior piece is nested.

The overlapping or nested pieces of flashing material are capable of being selectively sized so that the overall length of the flashing can be lengthened or shortened depending upon the particular installation where the flashing is to be installed. To selectively size the flashing, a user may simply grasp either piece of flashing and pull or push the flashing pieces to set the flashing device at the desired length. During this manipulation, the partially open hems allow sliding engagement of the pieces to take place, but the nested closed hems ensure that the pieces of flashing material remain connected.

The shape of the flashing pieces may be formed to meet specifications for a particular installation. For example, in one preferred embodiment, the flashing may be defined as a drip edge flashing in which both of the pieces are bent at an approximately 90° angle along a longitudinal axis and length of the material.

In another preferred embodiment, the flashing may be defined as L-flashing that is typically adapted for use in sealing an object that may protrude above the surface of a roof such as a skylight or roof vent. In this embodiment, the L-flashing may adopt flashing pieces that are bent at greater or less than 90° angles depending upon the pitch of the roof where the object is mounted on the roof, but the L-flashing of the invention may be provided with a 90° angle.

In yet another preferred embodiment, the flashing may be defined as counter flashing which is similar to the L-flashing, except that the overall width of the flashing pieces may be greater to account for an increased surface area over which weatherproofing is required according to building code requirements.

In yet another preferred embodiment, the flashing may be defined as roof to wall flashing which is again similar to the L-flashing, except that the overall width of the flashing pieces may be greater and one side edge of the flashing may have a width that is significantly different than the width of the other side edge.

In yet another preferred embodiment, the flashing may be defined as valley flashing in which the flashing pieces include a V-shaped bend that extends along a central longitudinal axis of the flashing pieces.

In each of the embodiments, it is contemplated that a user may selectively choose which type of hem to use on the opposing side edges of the flashing pieces. As mentioned, one combination includes use of a fully closed hem and a partially open hem.

Considering the above features of the invention, in one aspect, it may be considered a flashing device especially adapted for weatherproofing a structure, comprising: (i) a first piece of shaped material having a length and opposite lateral side edges; (ii) a second piece of shaped material having a length and opposite lateral side edges; (iii) said opposite lateral side edges of said first and second pieces each having a hemmed edge formed thereon, each hemmed edge including a hem made in both said first and second pieces of material; (iv) wherein said hems on each opposite lateral side edge includes a closed hem and a partially open hem; and (v) wherein said first piece overlaps said second piece and said closed hem and said partially open hem on each opposite lateral side edge are nested with one another.

According to another aspect of the invention it may be considered a flashing device especially adapted for weatherproofing a structure, comprising: (i) a first piece of shaped material having a length and opposite lateral side edges; (ii) a second piece of shaped material having a length and opposite lateral side edges; (iii) said opposite lateral side edges of said first and second pieces each having a hemmed edge formed thereon, each hemmed edge including a hem made in both said first and second pieces of material; (iv) wherein said hems on each opposite lateral side edge includes a closed hem and a partially open hem; and (v) wherein said first piece selectively overlaps said second piece to cover said first piece and said closed hem is placed within said partially open hem on each opposite lateral side of said first and second pieces thereby enabling said pieces to be selectively slidable with one another to adjust a desired length of the flashing device between a minimum and maximum flashing length.

According to yet another aspect of the invention it may be considered a flashing system especially adapted for weatherproofing a structure, comprising at least first and second flashing devices according to either of the above described aspects of the invention.

According to yet another aspect of the invention it may be considered a method of installing flashing for use in weatherproofing a structure, said method comprising: providing a flashing device comprising: (i) a first piece of shaped material having a length and opposite lateral side edges; (ii) a second piece of shaped material having a length and opposite lateral side edges; (iii) said opposite lateral side edges of said first and second pieces each having a hemmed edge formed thereon, each hemmed edge including a hem made in both said first and second pieces of material; (iv) wherein said hems on each opposite lateral side edge includes a closed hem and a partially open hem; and (v) wherein said first piece selectively overlaps said second piece to cover said first piece and said closed hem is placed within said partially open hem on each opposite lateral side of said first and second pieces; determining a length on said structure that requires weatherproofing; installing said flashing device on said structure; and selectively sliding the first or second pieces to adjust a length of the flashing device between a minimum and maximum flashing length and to match said determined length on said structure.

A number of optional features may be adopted with any of the above described aspects, these optional features including: (i) a longitudinal bend extending along a length of the first and second pieces and located at a selected width distance between said opposite lateral side edges; (ii) said closed hem is formed by a closed bend made in a lateral side edge of one of said first or second pieces, said closed bend having a bend angle of approximately 180°; (iii) said partially open hem is formed by a partial bend made in a lateral side edge of one of said first or second pieces, said partial bend having a bend angle of approximately 150-160°; (iii) an offset distance is provided between a tip of a free end of said first piece and an exposed surface of said first piece; (iv) an end gap is provided between facing lateral side surfaces of the first and second pieces; and (v) a longitudinal gap is provided between facing longitudinal side surfaces of bended portions of said first and second pieces.

Other features and advantages of the invention will become apparent from a review of the following description taken in conjunction with the drawings.

DETAILED DESCRIPTION

Figure 1:
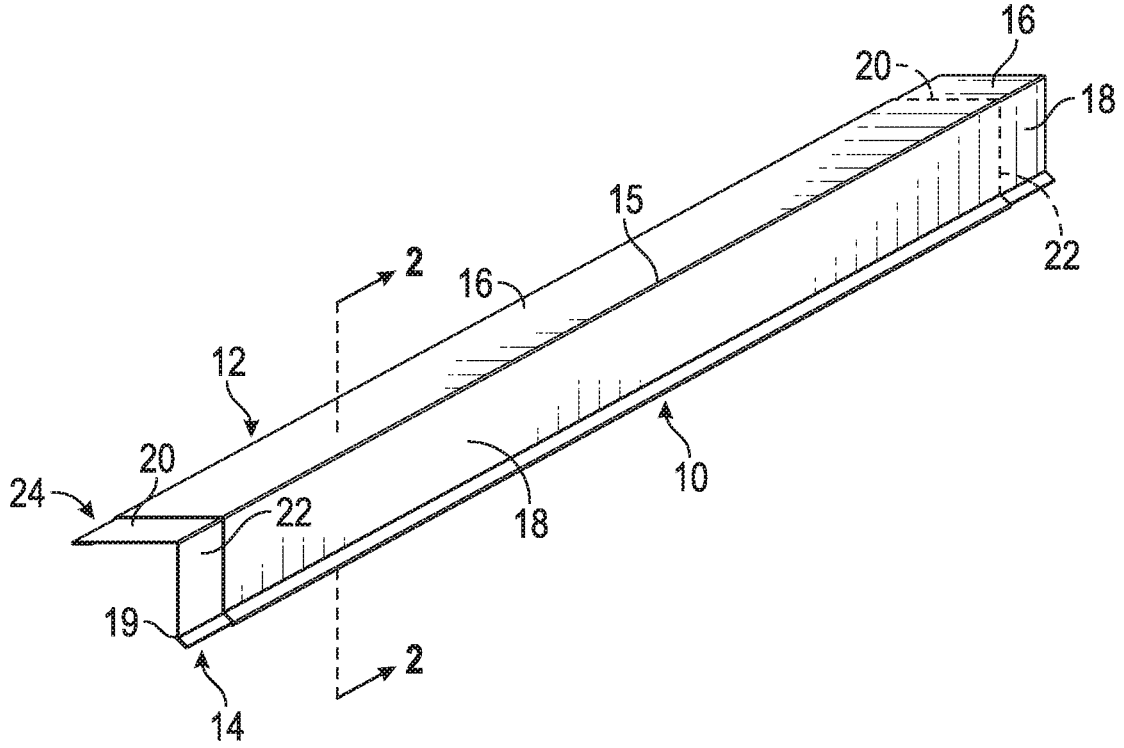
FIG. 1 is a perspective view of a first embodiment of the flashing device of the invention.
Figure 2:
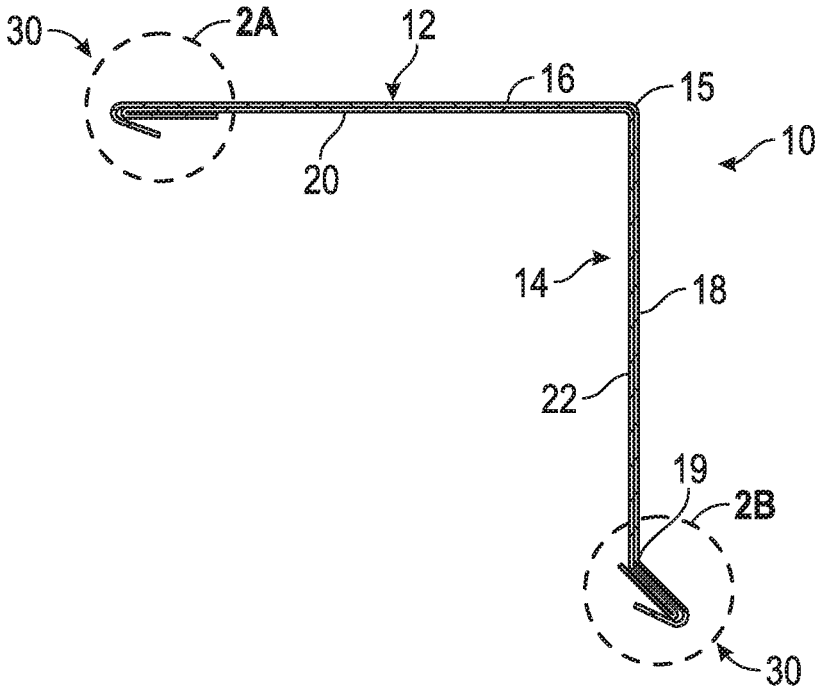
FIG. 2 is a cross-sectional view of FIG. 1 taken along line 2-2.

FIG. 1 illustrates a first embodiment of the invention in the form of a flashing device 10 especially adapted for providing weatherproofing to a structure such as a building. The flashing device 10 may be installed as a weatherproofing element for many different types of structures. The flashing device has two components or parts, namely, a first flashing piece 12 and a second flashing piece 14 that is provided in a nested configuration with the first flashing piece 12. Referring also to FIG. 2, the flashing device 10 comprises the first and second pieces 12 and 14 in which the first piece 12 overlies the second piece as shown. The first and second pieces are shown having a common mid-width bend 15 that extends longitudinally along the lengths of the pieces at an approximate 90° angle. The first and second pieces are also shown having another common bend 19 located on one lateral side of the device 10, this second bend 19 being shown at a bend angle of approximately 45°.

The first flashing piece 12 may be further described as having a first side or surface 16 and a second side or surface 18, each side being disposed on opposite sides of the longitudinal bend 15. Similarly, the second flashing piece may also be further described as having a first side or surface 20 and a second side or surface 22 with each side being disposed on opposite sides of the longitudinal bend 15.

FIG. 1 shows the device 10 in a partially expanded state in which a significant length of the first piece and second piece overlap one another. More specifically, the overall length of the device 10 is lengthened by an extended portion 24 in which part of the second piece 14 is exposed. The first and second pieces are slidable or shiftable with one another so that the user can select a desired overall length for the device 10 depending upon the particular installation.

Figure 2A:
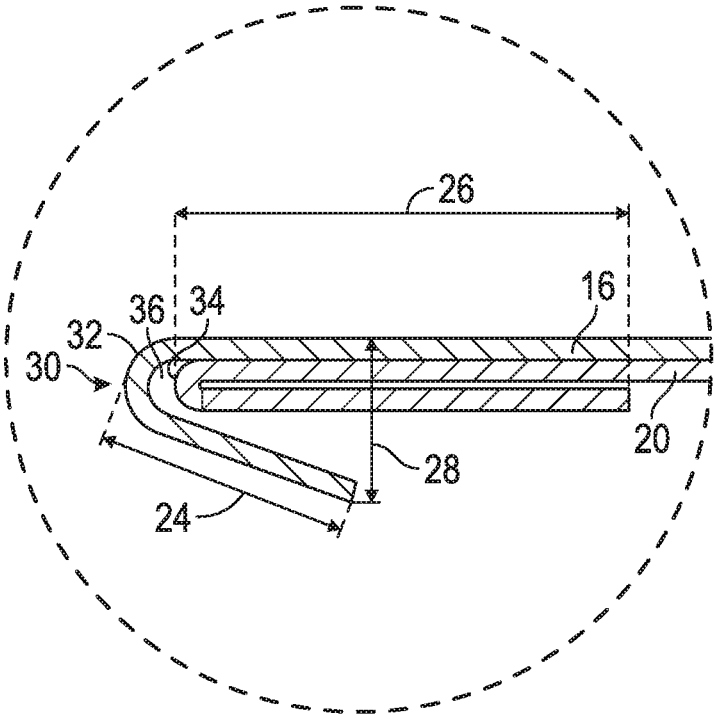
FIG. 2A is a greatly enlarged view of a portion of FIG. 2 illustrating details for a hem connection showing a partially closed hem for a first piece and an a fully closed hem for a second piece.

Referring to FIG. 2A, details are illustrated with respect to the hems created on the respective flashing pieces. A combined or overlapping hemmed edge 30 is created by bending the edges of the overlapped or nested pieces 12 and 14. As shown, the first piece 12 incorporates a partially open hem 32 characterized by a corresponding bend made in the first piece 12, while the second piece 14 incorporates a fully closed hem 34 characterized by another corresponding bend made in the second piece 14. A bend length may define the length of a piece that is bent, this bend length being shown as bend length 24 for the first piece 12, and bend length 26 for the second piece 14. The bend length 26 is shown as being greater than the bend length 24; however, it should be understood that each of the bend lengths can be selectively sized by the user. Another measurement illustrated is the offset distance 28 that is measured by the distance between the tip of the free end of the first piece 12 and the exposed surface of the first piece 12 as shown. This distance is also selectable by the user to modify necessary design considerations in which this offset distance may require it to be of different distances to prevent the corresponding side edge of the device from interfering with elements of a roof design. A small end gap 36 is present between the facing lateral side surfaces of the first and second pieces 12 and 14 which enables the pieces to be slidable with respect to one another without having to exert excessive force, yet the end gap 36 is not so great which would otherwise allow the pieces to be easily separated. Preferably, this end gap should be at least equal to or greater than the thickness of the material. An estimated end gap could therefore be between about 1/16th of an inch to 1/8th of an inch. A variance or range of the gap 36 comprises the combined gaps or spaces created by bends made in the two pieces of material, namely, the partially open hem and the fully closed hem.

Figure 2B:
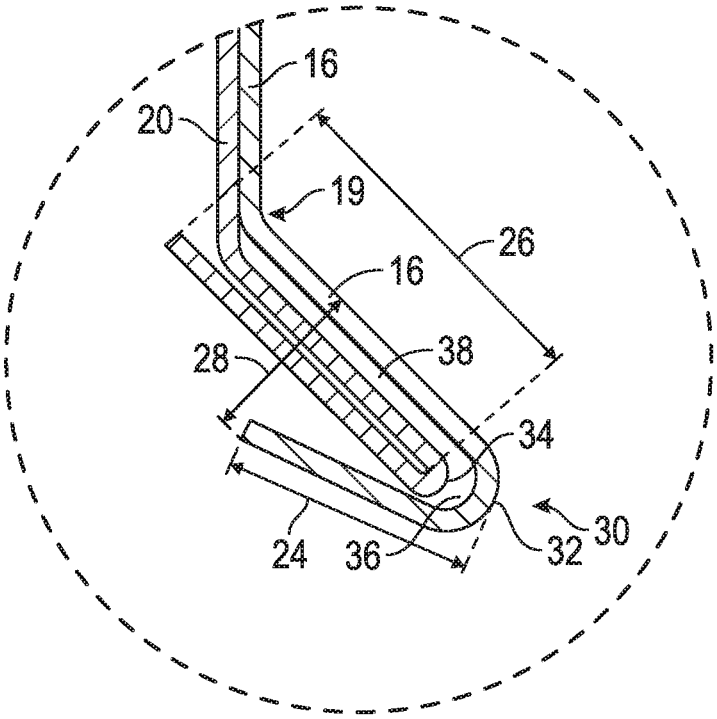
FIG. 2B is a greatly enlarged view of another portion of FIG. 2 illustrating details for the hem connection on the opposite side of the device showing a partially closed hem for the first piece, a fully closed hem for the second piece, and a bend located near the free end of the second piece.

Referring to FIG. 2B, a similar configuration is shown for the opposite side edge of the device 10 in which the device incorporates a closed hem on one piece and a partially open hem on the other piece. Additional characteristics of the nested pieces of material are illustrated including the respective bend lengths 24 and 26, and the offset distance 28. The offset distance could be, for example, between about $1/8^{th}$ of an inch to 1/4th of an inch. A small longitudinal gap 38 is present between the facing longitudinal side surfaces of the bended portions of the first and second pieces which further enable the pieces to be slidable with respect to one another. The size of the longitudinal gap 38 could also be approximately $1/16^{th}$ of an inch to $1/8^{th}$ of an inch.

Figure 3:
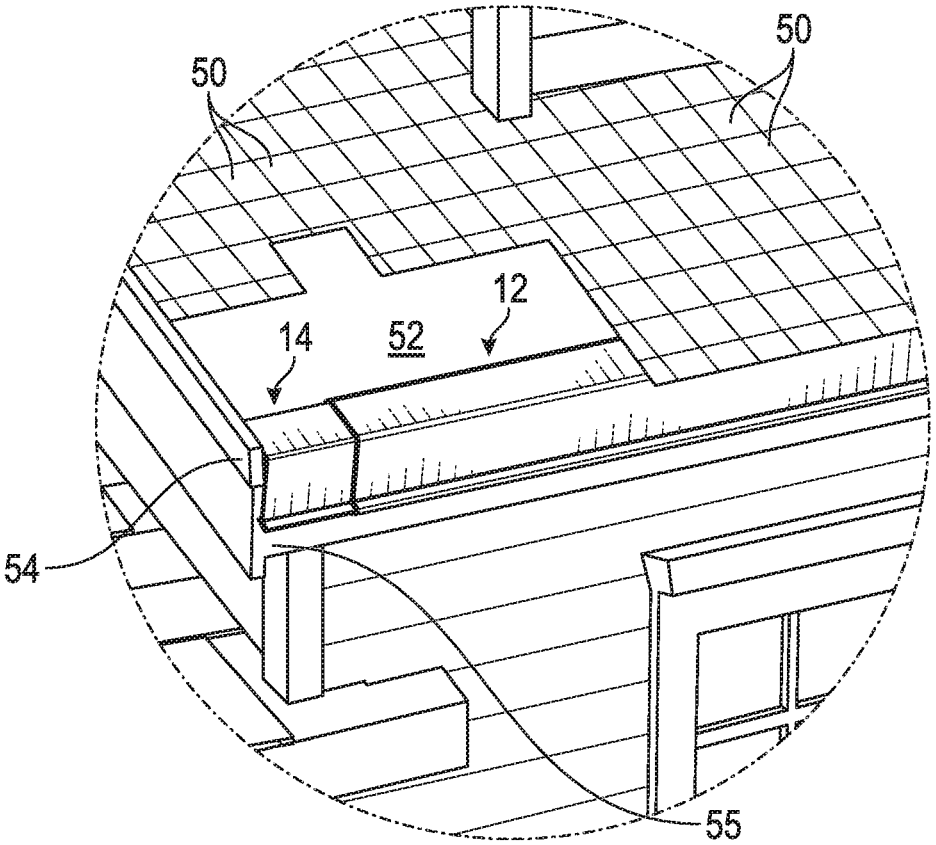
FIG. 3 is a perspective view of the first embodiment of the flashing device installed as a drip edge on a structure.

Referring to FIG. 3, the device 10 of the first embodiment is shown as being installed as perimeter flashing on a drip edge of a structure. As shown, the device is installed so that one lateral side of the device extends vertically below the edge of the corresponding section of roof, and the other lateral side edge of the device is secured to the roof. The roof tiles or shingles 50 are removed on a portion of this figure to expose the installation of the device. In a typical installation, the one lateral side edge of the device is placed over the roofing underlayment 52 and under the roof tiles/shingles 50. As also shown, the device has been expanded or lengthened so that a portion of the second piece 14 is exposed. One end of the device with the exposed portion of the second piece 14 abuts the fascia 54 of the roof, while the opposite end of the device including piece 12 extends along the roof eve or roof edge 55.

Figure 4:
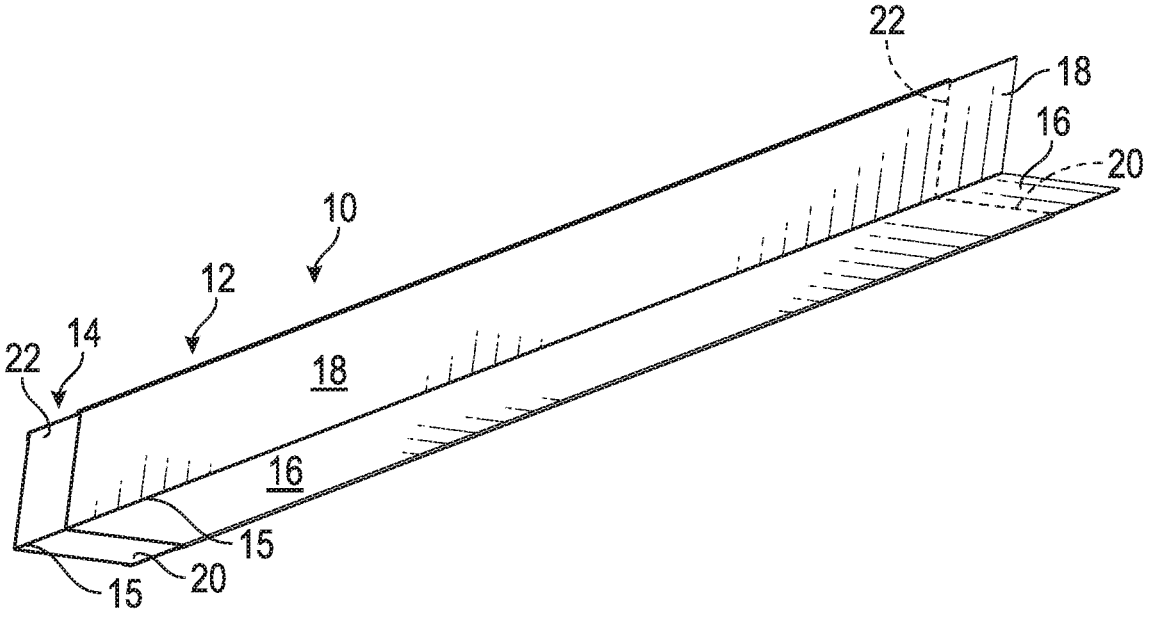
FIG. 4 illustrates a perspective view of a second embodiment of the flashing device of the invention, similar to the first embodiment, but without the bend.
Figure 5:
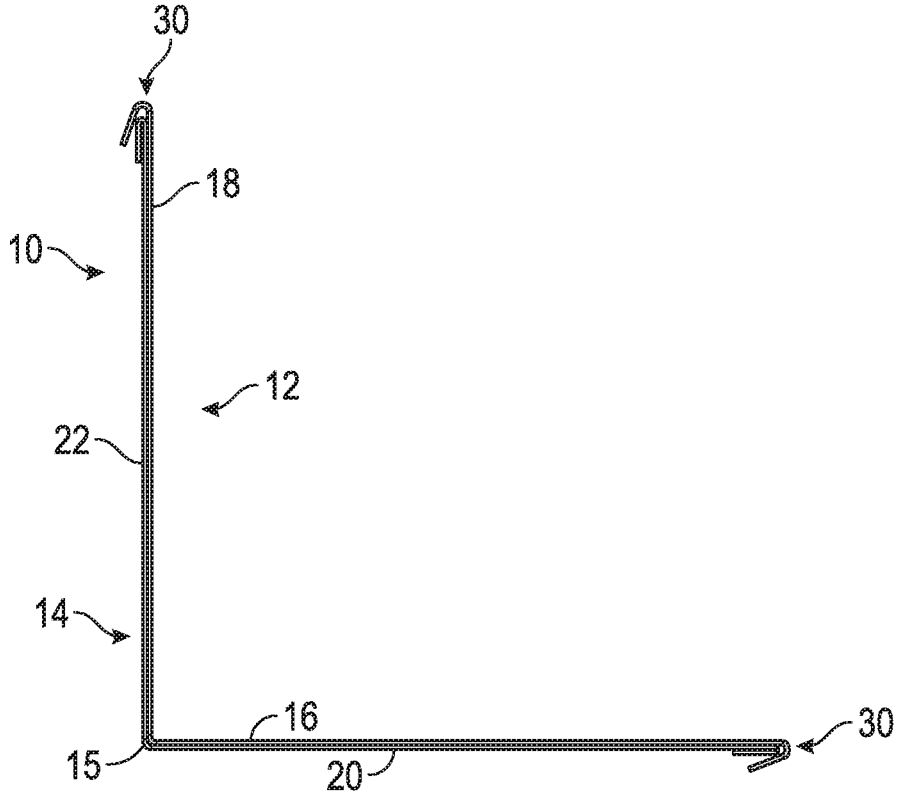
FIG. 5 is a cross-sectional view of FIG. 4.

Referring to FIGS. 4 and 5, a second embodiment of the device 10 is illustrated. The same reference numerals used in these figures denote the same structural features from the first embodiment. The second embodiment is the same as the first embodiment with the exception that there is no bend 19 incorporated on the device such that the first and second pieces have a single bend 15. It should also be understood that the lateral side edges of the device include the same details as set forth in FIG. 2A with respect to the specific structural arrangement of the hems and corresponding bended portions of the first and second pieces. Accordingly, one piece of the device incorporates a partially open hem while another piece incorporates a closed hem.

Figure 6:
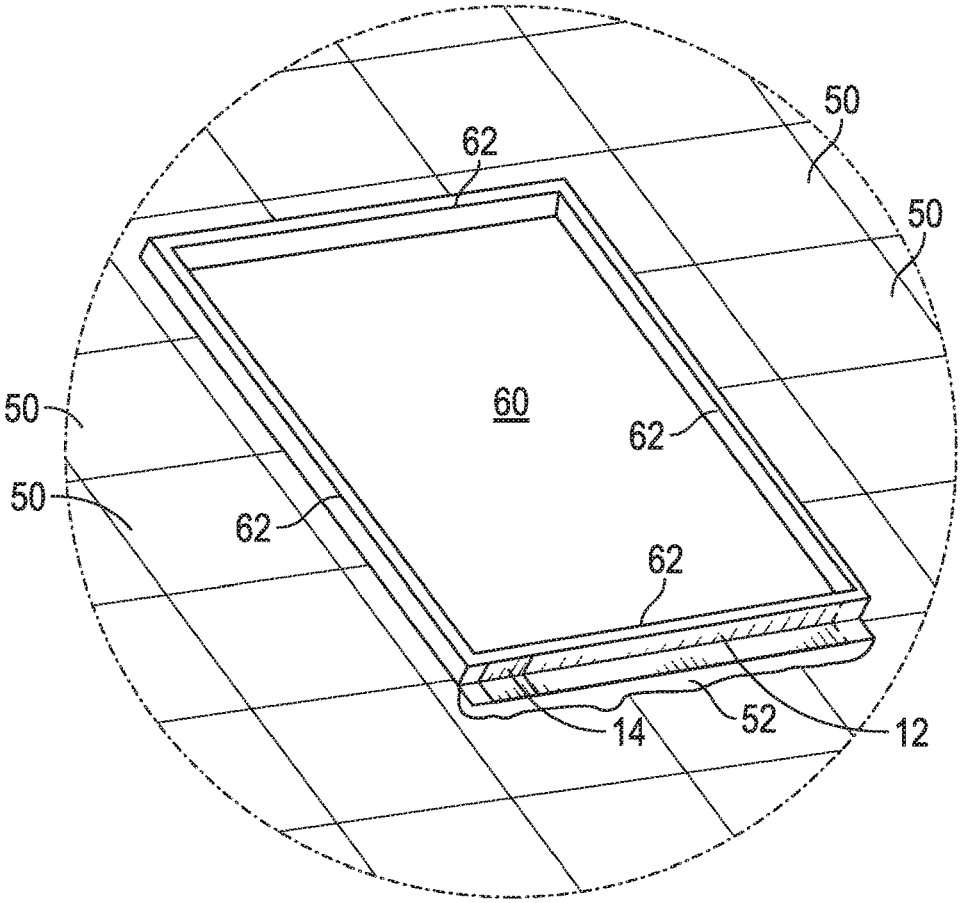
FIG. 6 is a perspective view of the second embodiment of FIG. 4 installed as L-flashing on a structure.

Referring to FIG. 6, the second embodiment is shown as being installed as L-flashing in which the approximate 90° bend angle is able to accommodate weatherproofing for the depicted sky light 60. The frame 62 of the sky light 60 projects above the surface of the roof shingles/tiles 50. The device 10 is installed such that one lateral side edge covers the vertically facing surface of the corresponding frame element 62, while the other lateral side edge of the device extends under the roofing shingles/tiles which abut the frame 62. In the figure, a portion of the tiles/shingles are again broken way along the lower frame element 62 to show the device 10 installed.

Figure 7:
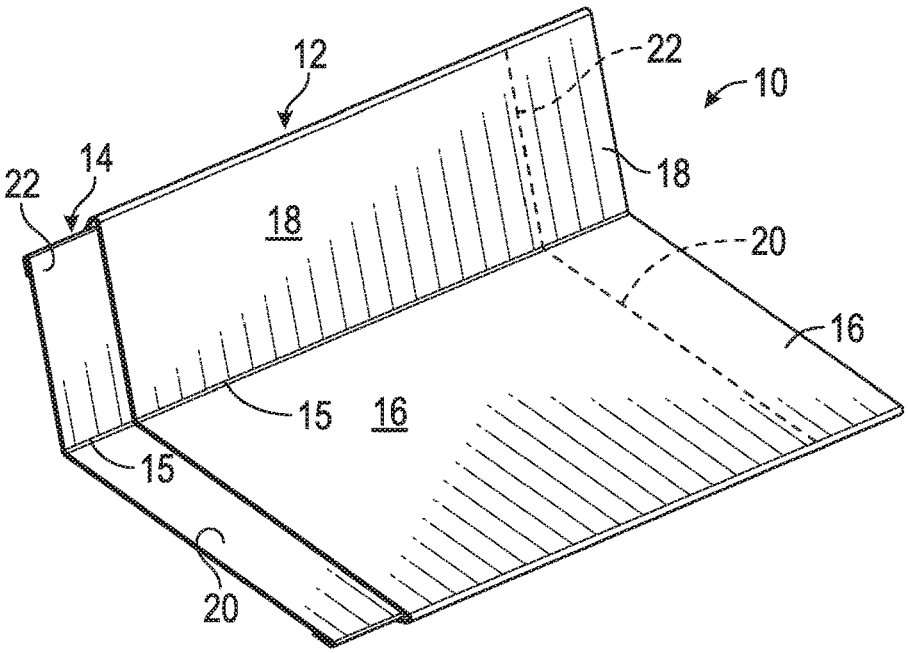
FIG. 7 illustrates a perspective view of a third embodiment of the flashing device of the invention.
Figure 8:
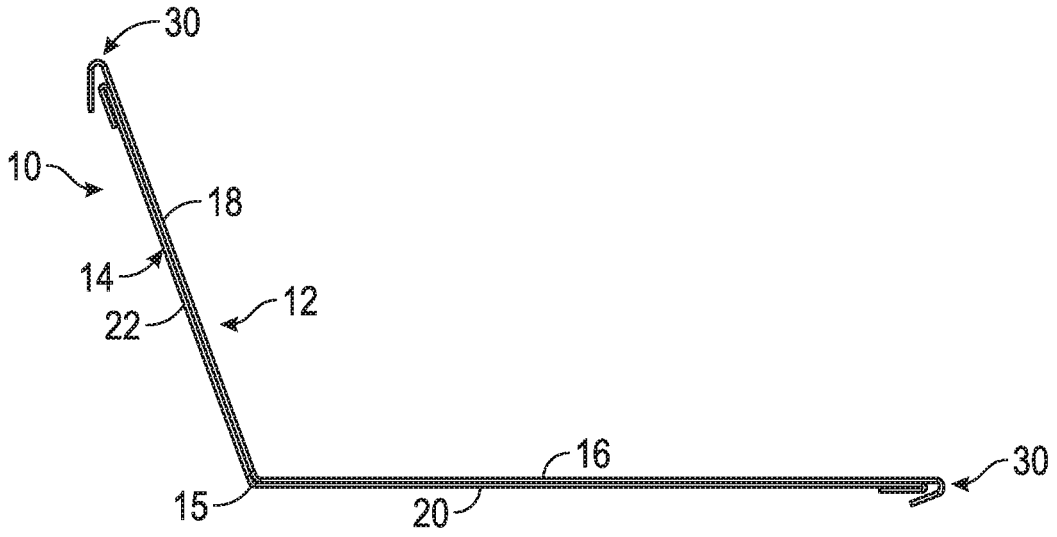
FIG. 8 is a cross-sectional view of FIG. 7.

Referring to FIGS. 7 and 8, a third embodiment of the device 10 is illustrated. The third embodiment is also similar to the first embodiment with the exception that there is no bend 19 such that the first and second pieces 12, 14 have a single bend 15. The single bend 15 is provided at a greater angle than 90°, for example approximately 110°, as shown. This greater single bend is illustrated for purposes of confirming that this single bend may be provided at any desired angle by the user to adapt the device to provide weatherproofing for different elements found on a roof structure that may be disposed that various different angles with respect to the roof. Again, the same reference numerals used in these figures denote the same structural features from the first embodiment and the lateral side edges of the device include the same details as set forth in FIG. 2A with respect to the specific structural arrangement of the hems; accordingly, one piece of the device incorporates a partially open hem while another piece incorporates a closed hem.

Figure 9:
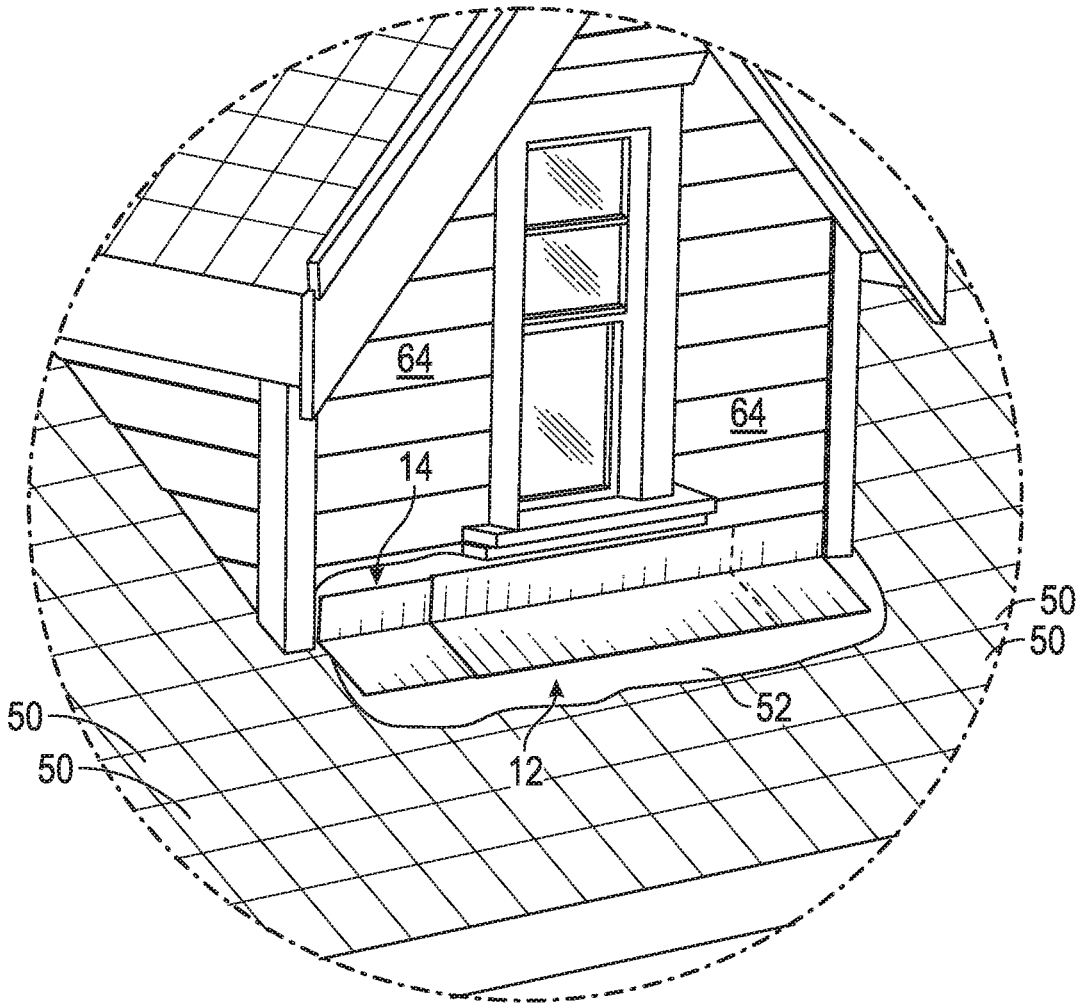
FIG. 9 is a perspective view of the third embodiment of FIG. 7 installed as counter flashing or roof to wall flashing.

Referring to FIG. 9, the third embodiment is shown as being installed as counter or roof to wall flashing in which the greater single bend is able to accommodate weatherproofing between a vertical element and the roof. More specifically, the device 10 is installed such that one lateral side edge covers the vertically facing surface of the vertical element or exterior wall 64, while the other lateral side edge of the device extends under the roofing shingles/tiles which abut the lower edge of the exterior wall 64. Again in this figure, a portion of the tiles/shingles 50 as well as a portion of the wall 64 is broken away to better show the device 10 installed.

Figure 10:
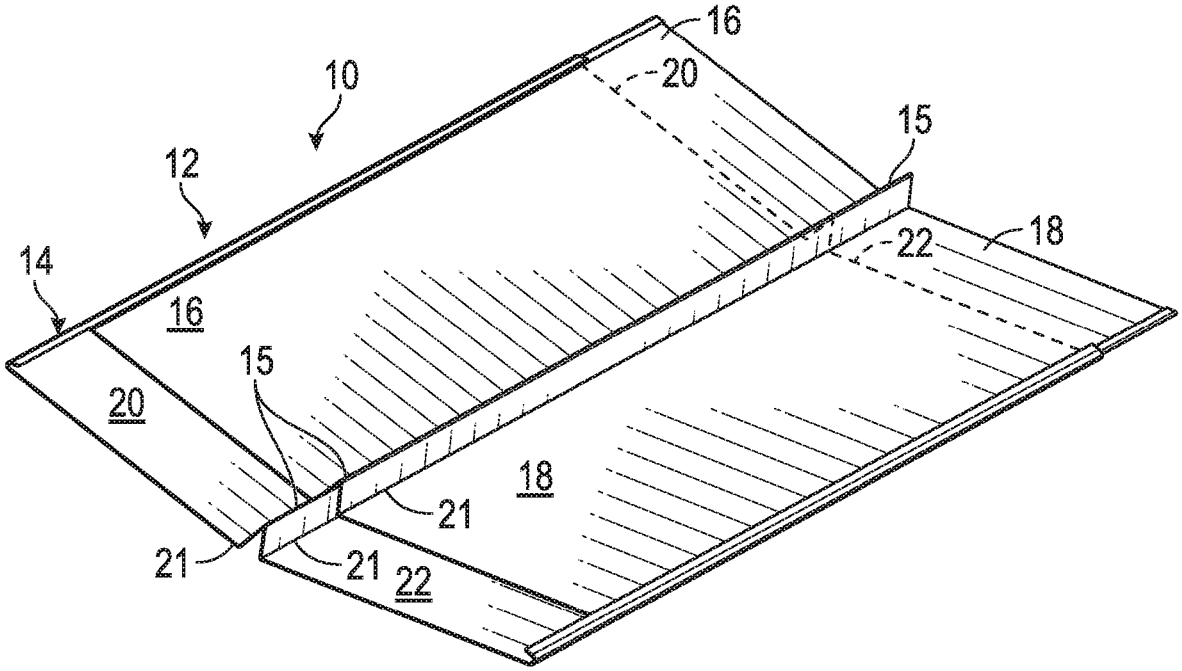
FIG. 10 is a perspective view of a fourth embodiment of the flashing device of the invention.
Figure 11:
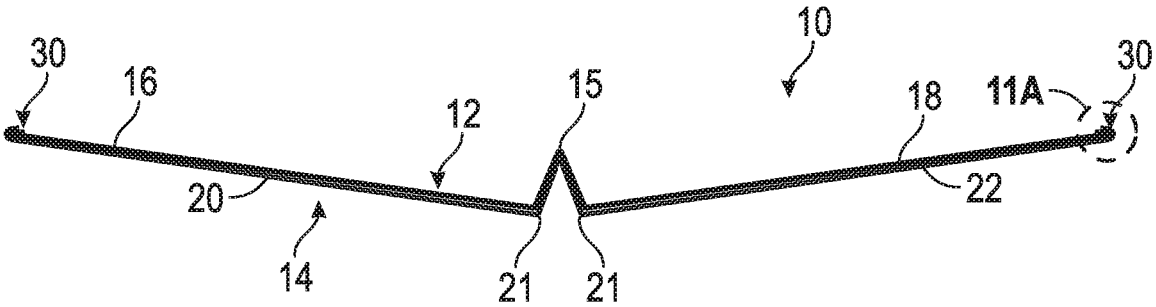
FIG. 11 is a cross-sectional view of FIG. 10.
Figure 11A:
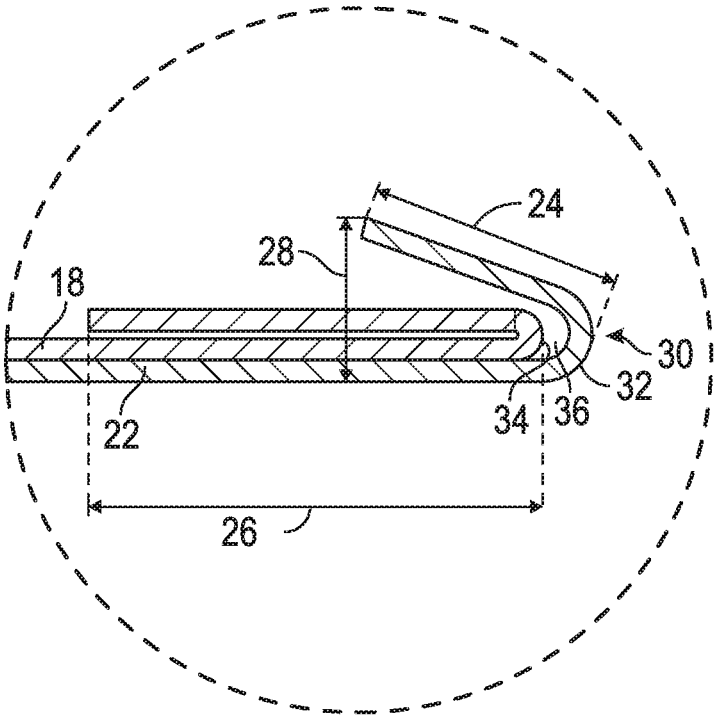
FIG. 11A is a greatly enlarged view of a portion of FIG. 11, similar to FIG. 2A but illustrated with a reversed hemmed connection; and further showing the details for the hemmed connection with the partially closed hem formed on one piece of material and the fully closed hem formed on the other piece of material.

Referring to FIGS. 10, 11 and 11A, a fourth embodiment of the device 10 is illustrated. The fourth embodiment is also similar to the first embodiment with the exception that there is no bend 19 but the first and second pieces do have a single central or mid-width bend 15. Further, the device has two additional bends laterally spaced from the mid-width bend 15. These two additional bends are shown as bends 21 that are closely spaced from the mid-width bend 15. These bends 21 are provided at bend angles that are approximately 90°. The mid-width bend 15 is also provided at a greater angle in which this configuration of the bend 15 and laterally spaced bends 21 provide the central portion of the device with a v-shaped protrusion. Again, the same reference numerals used in these FIGS. 10 and 11 denote the same structural features from the first embodiment and the lateral side edges of the device include the same details as set forth in FIG. 2A, however the bend is reversed so that according to the view of FIG. 11A, the bend of the piece of the device that incorporates the partially open hem is upwardly bent, and the other piece incorporates the closed hem.

Figure 12:
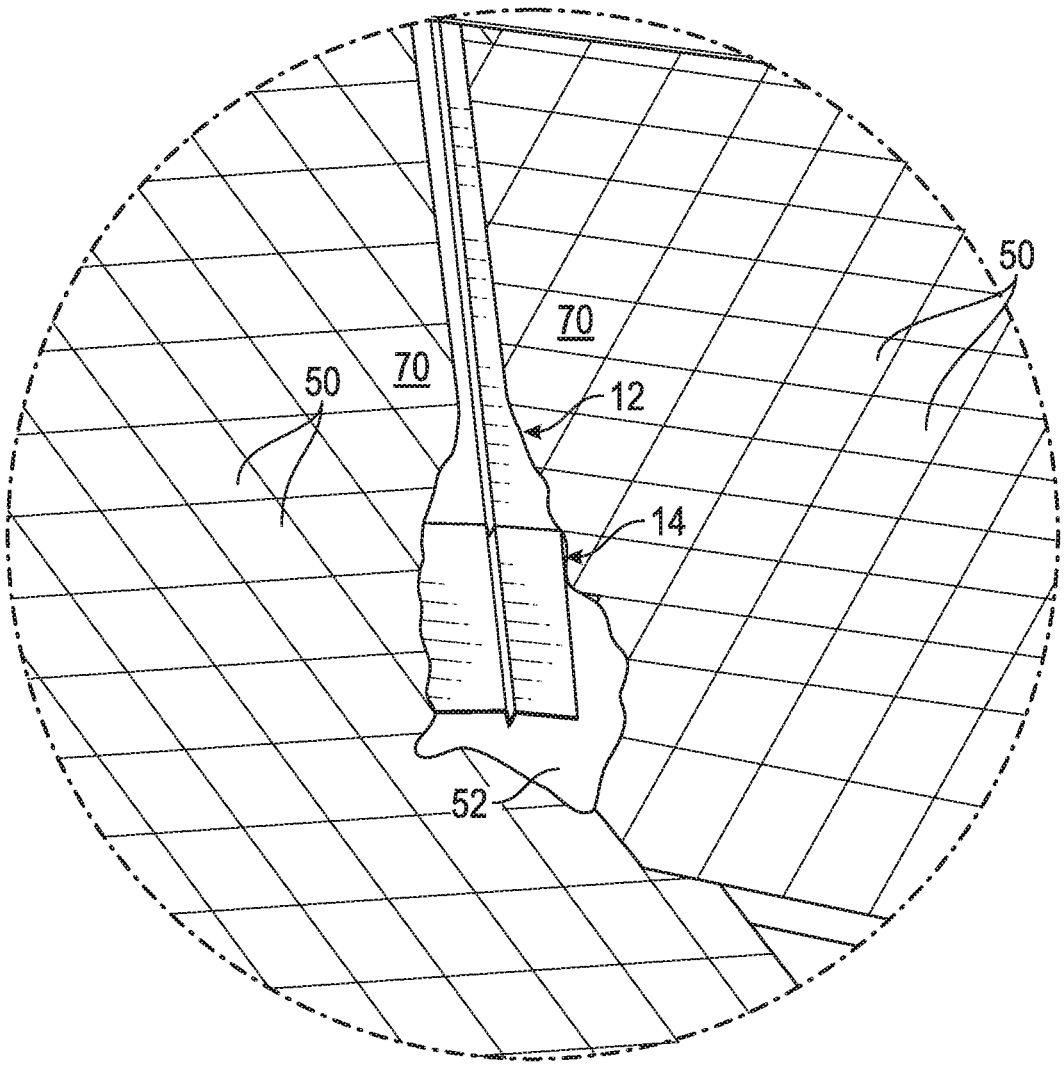
FIG. 12 is a plan view of the fourth embodiment of FIG. 10 installed as valley or channel flashing.

Referring to FIG. 12, the fourth embodiment is shown as being installed as channel or valley flashing in which two adjacent roof surfaces intersect at a valley or channel on the roof. The angles of the bends 21 accommodate the converging angles of the adjacent roof surfaces 70 such that v-shaped protrusion serves as a stop or abutting surface for the edges of the roofing tiles/shingles that lie on both opposite side edges of the protrusion. Again in this figure, a portion of the tiles/shingles 50 is broken away to better show the device 10 as installed.

In each of the installed embodiments as illustrated, it should be apparent that the length of the device can be adjusted to accommodate specific peculiarities in the various installation applications for varying types of structures. The adjustability of the length of the device reduces downtime associated with sizing and cutting of material. Further, there is some additional strength that is provided from the device since there is at least some length of the device that is overlapped with two pieces of material. The seams provided along both lateral edges of the device ensure that the device can be easily adjusted for desired lengths, yet the respective pieces of material will remain connected to one another.

According to yet another aspect of the invention, in another embodiment, it can be considered a flashing system that includes a plurality of selected types of flashing devices according to the other preferred embodiments of the devices of the invention disclosed herein. Accordingly, the flashing system may comprise a selected combination of flashing devices for installation on a structure which requires multiple areas to be weatherproofed.

According to yet another aspect of the invention, in another embodiment, it can be considered a method of installing flashing for use in weatherproofing a structure. The method includes providing a flashing device according to any of the above described devices of the invention. Once a flashing device is selected, a user determines a length on the structure that requires weatherproofing. The selected flashing device is installed in which the first or second pieces are adjustable between a minimum and maximum flashing length to match the determined length on the structure where weatherproofing is required.

Although the invention has been described herein with respect to multiple preferred embodiments of a device, system and method, it should be understood that various changes and modifications to these embodiments can be made commensurate with the scope of the claims appended hereto.

What is claimed is:

1. A method of installing flashing for use in weatherproofing a structure, said method comprising:

providing a flashing device comprising: (i) a first piece of shaped material having a length and opposite lateral side edges; (ii) a second piece of shaped material having a length and opposite lateral side edges; (iii) said opposite lateral side edges of said first and second pieces each having a hemmed edge formed thereon;

wherein said first piece selectively overlaps said second piece to cover said first piece and said hems of said second piece are placed within corresponding hems on each opposite lateral side of said first piece;

wherein said hems on each opposite lateral side edge of one of said first and second pieces includes a closed hem and the other of said first and second pieces includes at least one partially open hem, each said closed hem having a bend angle of approximately 180°;

determining a length on said structure that requires weatherproofing;

installing said flashing device on said structure; and selectively sliding the first or second pieces to adjust a length of the flashing device between a minimum and maximum flashing length and to match said determined length on said structure.

2. The method of installing flashing for use in weatherproofing a structure according to claim 1 further including:

placing a longitudinal bend extending along a length of the first and second pieces and located at a selected width distance between said opposite lateral side edges.

3. The method of installing flashing for use in weatherproofing a structure according to claim 1 wherein: said partially open hem is formed by a partial bend made in a lateral side edge of said second piece, said partial bend having a bend angle of approximately 150-160°.

4. The method of installing flashing for use in weatherproofing a structure according to claim 1 wherein:

an offset distance as measured between a tip of a free end of said first piece and an exposed surface of said first piece is between about $1/8^{th}$ of an inch to $1/4^{th}$ of an inch.

5. The method of installing flashing for use in weatherproofing a structure according to claim 1 wherein:

an end gap is provided between facing lateral side surfaces of the first and second pieces.

6. The method of installing flashing for use in weatherproofing a structure according to claim 5 wherein:

said end gap is between about 1/16th of an inch to 1/8th of an inch.

7. The method of installing flashing for use in weatherproofing a structure according to claim 1 wherein:

a longitudinal gap is provided between facing longitudinal side surfaces of bended portions of said first and second pieces.

8. The method of installing flashing for use in weatherproofing a structure according to claim 7 wherein:

said longitudinal gap is between about 1/16th of an inch to 1/8th of an inch.

9. A method of installing flashing for use in weatherproofing a structure, said method comprising:

providing a flashing device comprising: (i) a first piece of shaped material having a length and opposite lateral side edges; (ii) a second piece of shaped material having a length and opposite lateral side edges; (iii) a lateral side edge of said first and second pieces each having an edge, each said edge including a hem wherein one of said hems is a closed hem and the other of said hems is a partially open hem;

placing said first piece to selectively overlap said second piece wherein a hem of one of said first or second pieces is placed within the hem of the other of said first or second pieces;

wherein said hems on each opposite lateral side edge of one of said first and second pieces includes a closed hem and the other of said first and second pieces includes at least one partially open hem, each said closed hem having a bend angle of approximately 180°;

determining a length on said structure that requires weatherproofing;

installing said flashing device on said structure; and selectively sliding the first or second pieces to adjust a length of the flashing device between a minimum and maximum flashing length and to match said determined length on said structure.

10. A method of installing a flashing device for use in weatherproofing a structure, said method comprising:

providing a first piece of shaped material having a length and opposite lateral side edges;

providing a second piece of shaped material having a length and opposite lateral side edges;

said opposite lateral side edges of said first and second pieces each having a hem formed thereon;

wherein said first piece selectively overlaps said second piece to cover said second piece;

placing each said hem of said second piece in a corresponding hem of said first piece thereby enabling said pieces to be selectively slidable with one another to adjust a desired length of the flashing device between a minimum and maximum flashing length;

wherein said hems on each opposite lateral side edge of one of said first and second pieces includes a closed hem and the other of said first and second pieces includes at least one partially open hem, each said closed hem having a bend angle of approximately 180°;

determining a length on said structure that requires weatherproofing;

installing said flashing device on said structure; and selectively sliding the first or second pieces to adjust a length of the flashing device between the minimum and maximum flashing length and to match said determined length on said structure.

11. The method of installing a flashing device for use in weatherproofing a structure according to claim 10 further including:

placing a longitudinal bend extending along a length of the first and second pieces and located at a selected width distance between said opposite lateral side edges.

12. The method of installing a flashing device for use in weatherproofing a structure according to claim 10 wherein:

said partially open hem is formed by a partial bend made in a lateral side edge of one of said first or second pieces, said partial bend having a bend angle of approximately 150-160°.

13. The method of installing a flashing device for use in weatherproofing a structure according to claim 10 wherein:

an offset distance as measured between a tip of a free end of said first piece and an exposed surface of said first piece is between about 1/8th of an inch to 1/4th of an inch.

14. The method of installing a flashing device for use in weatherproofing a structure according to claim 10 wherein:

an end gap is provided between facing lateral side surfaces of the first and second pieces.

15. The method of installing a flashing device for use in weatherproofing a structure according to claim 10 further including:

placing a longitudinal gap between facing longitudinal side surfaces of bended portions of said first and second pieces.

* * * * *